US006257713B1

(12) United States Patent
Ahn

(10) Patent No.: US 6,257,713 B1
(45) Date of Patent: Jul. 10, 2001

(54) DEVICE FOR REFILLING COLOR INKS IN AN INK-JET PRINTER

(75) Inventor: Byung-Sun Ahn, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/832,619

(22) Filed: Mar. 31, 1997

(30) Foreign Application Priority Data

Mar. 29, 1996 (KR) ..... 1996-9214

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 4,150,673 * 4/1979 Watt ..... 128/272
4,771,295 * 9/1988 Baker et al. ..... 347/87
5,454,409 * 10/1995 McAffer et al. ..... 141/329
5,572,852 * 11/1996 Crystal et al. ..... 53/428
5,595,223 * 1/1997 Hayao ..... 141/375
5,607,003 * 3/1997 Gray ..... 141/285
5,777,646 * 7/1998 Barinaga et al. ..... 347/86
6,053,603 * 4/2000 Ito ..... 347/86

FOREIGN PATENT DOCUMENTS 62-161544 * 7/1987 (JP) .
6-106729 * 4/1994 (JP) .

* cited by examiner

*Primary Examiner*—N. Le
*Assistant Examiner*—Michael Nghiem
(74) *Attorney, Agent, or Firm*—Robert E. Bushnell, Esq.

(57) ABSTRACT

A carriage of a color ink-jet printer made of an ink storage case for storing color inks, an ejecting part for ejecting the color inks, a receptacle that may be made of a sponge for holding the color inks with a constant pressure, partitions for isolating the color inks with each other, a middle cap for preventing the color inks from shifting and flowing out, and a device for refilling the color inks, the device for refilling the color inks includes a first, second and third refilling part having different dimensions to distinguish the colors of the color inks.

14 Claims, 3 Drawing Sheets

DEVICE FOR REFILLING COLOR INKS IN AN INK-JET PRINTER

CLAIM OF PRIORITY

This application makes reference to, incorporates the same herein, and claims all benefits accruing under 35 U.S.C. §119 arising from an application for Device for Refilling Color Inks in an Ink-Jet Printer earlier filed in the Korean Industrial Property Office on Mar. 29, 1996 and there duly assigned Ser. No. 9214/1996.

1. Field of the Invention

The present invention concerns an ink-jet printer, and more particularly a device for refilling color ink in an inkjet printer.

2. Description of the Related Art

In contemporary designs for ink cartridges in ink jet printers, the cartridge is provided with partitions that isolate the three colored inks. As the color ink is consumed to such an amount as to miss pixel dots in the printed image due to a lack of colored ink, there is a requirement for the refilling of the color ink. It is substantially impossible to separate the upper cap and middle cap of the carriage. To refill the ink, the boss of the upper cap is first detached from the engine of the printer, and the upper cap is removed to refill the magenta, yellow and cyan inks through the first, second and third holes in the middle cap. The middle cap in contemporary systems has no distinct marking to distinguish the three holes. Hence, there is a probability of refilling the color ink through an incorrect hole, so that the print head is damaged, resulting in its replacement.

SUMMARY OF THE INVENTION

It is an object to provide a device for facilitating the correct refilling of the color ink even without any color markings on the outside of the ink storage case in a color ink-jet printer.

It is another object to provide a device for extending the life of the printing head of a color ink-jet printer.

It is still another object to reduce the number of steps to assemble the cartridge of a color ink-jet printer.

According to an aspect of the present invention, a cartridge of a color ink-jet printer is made up of an ink storage case for storing color inks, an ejecting part for ejecting the color inks, an elastic part made of a sponge for holding the color inks with a constant pressure, partitions for isolating the color inks with each other, a middle cap for preventing the color inks from shifting and flowing out, and a device for refilling the color inks, the device for refilling the color inks including a first, second and third refilling part having different dimensions to distinguish the colors from one another.

According to another aspect of the present invention, a cartridge of a color ink-jet printer is made up of an ink storage case for storing color inks, an ejecting part for ejecting the color inks, a receptacle made of a sponge for holding the color inks with a constant pressure, partitions for isolating the color inks with each other, a middle cap for preventing the color inks from shifting and flowing out, and a device for refilling the color inks, the device for refilling the color inks including an upper cap provided with a first, second and third refilling part having different dimensions to distinguish the colors from one another, and ink supply bellows for supplying the color inks to the ink storage case. The ink supply bellows are respectively provided with a first, second and third adapter having respective dimensions to fit with those of the first, second and third refilling part so as to carry out the correct refilling, and are also provided with respective caps for preventing leakage of the color inks.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
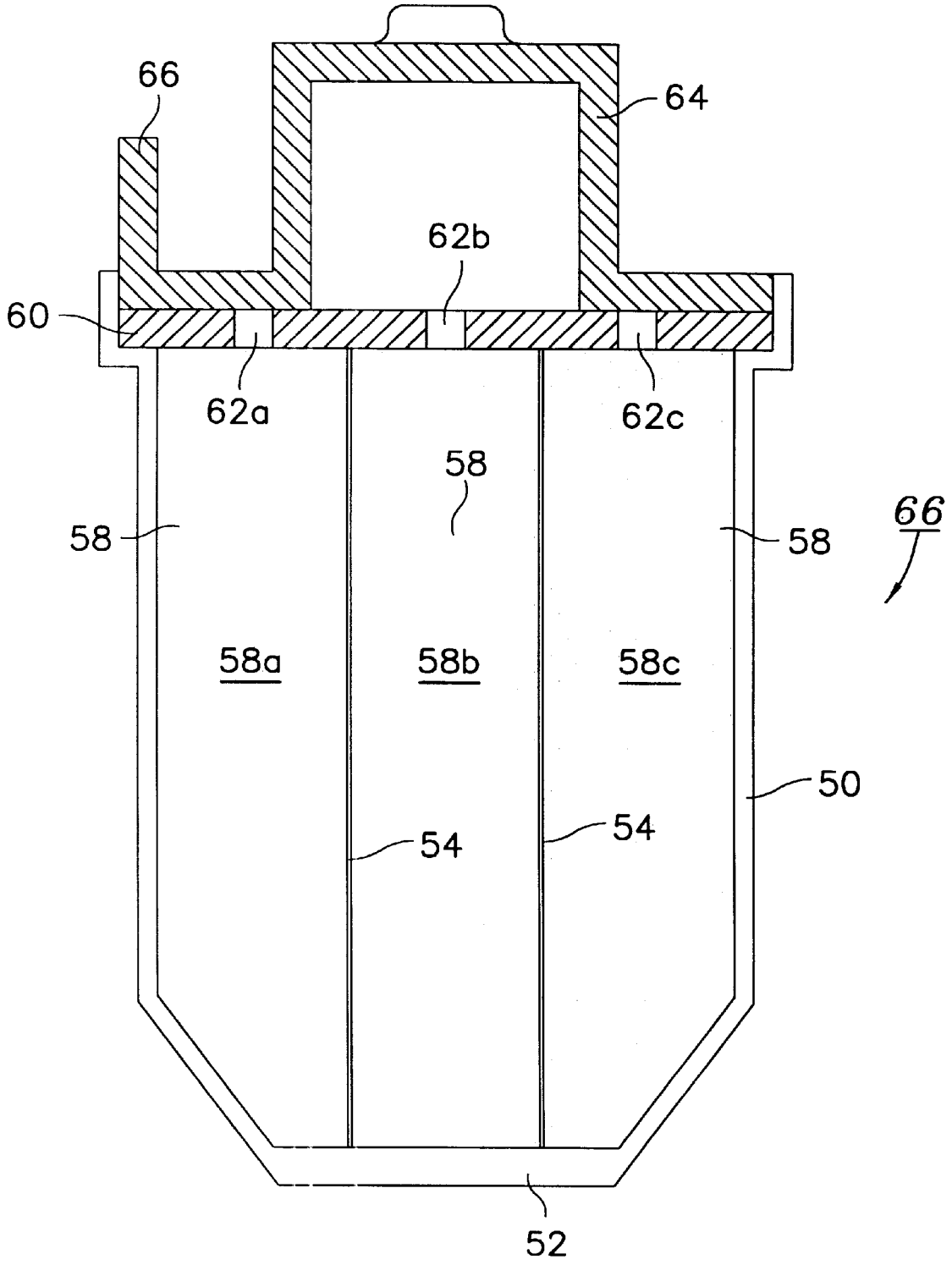
FIG. 1 is a schematic diagram for illustrating the structure of the cartridge of an earlier color ink-jet printer.

Referring to FIG. 1, the cartridge 66 of an ink-jet printer in earlier systems includes a print head for printing an image, an ejecting part 52 for ejecting color inks 58, i.e., magenta ink, yellow ink 58*b* and cyan ink 58*c*, an electrical connection for supplying the ejecting part with electrical power, and an ink storage case 50 integrated with the ejecting part 52. The ink storage case 50 stores the color inks 58, and is provided with partitions 54 to isolate the three color inks of magenta 58*a*, yellow 58*b* and cyan 58*c* from each other. Also provided between the partition 54 of ink storage case 50 are compartments or/ receptacles to hold the color inks 58 with a constant pressure by capillarity. Mounted on the upper end of the ink storage case 50 is a middle cap 60 sealed so as to prevent leakage of the color ink 58. The middle cap 60 is provided with a first, second and third hole 62*a*, 62*b* and 62*c* for respectively supplying the magenta, yellow and cyan ink 58*a*, 58*b* and 58*c* to the respective receptacles. In addition, an upper cap 64 is mounted on the middle cap 60 having a boss 68 fixedly connected with the engine part of the ink-jet printer not shown.

In operation, responding to an image data from a computer, the head driver generates image signals, according to which the magenta, yellow and cyan ink 58*a*, 58*b* and 58*c* contained in their separate receptacles are evaporated by a heater and ejected through the ejecting part 52 to the paper to print. As the color inks 58 contained in the receptacles are consumed to such an amount as to produce missing pixel dots in the printed image due to a lack of color ink, there is a requirement for the refilling of the color ink. Although there is the case that it is substantially, impossible to separate the upper cap 64 and middle cap 60 of the cartridge 66, there is also the case that it is possible to separate the upper cap 64 and the middle cap 60 so as to refill the color ink 58.

Describing the case to make it possible to refill the ink, the boss 68 of the upper cap 64 is first detached from the engine part of the printer, and the upper cap 64 is removed to refill the magenta, yellow and cyan ink 58*a*, 58*b* and 58*c*, respectively, through the first, second and third holes 62*a*, 62*b* and 62*c*, respectively, in middle cap 60. In this case, the middle cap 60 in earlier systems has no distinct marking to distinguish the three holes 62*a*, 62*b*, 62*c*. Hence, the probability becomes considerably great to refill the color ink 58 through an incorrect hole, so that the print head is damaged, resulting in its replacement.

Figure 2:
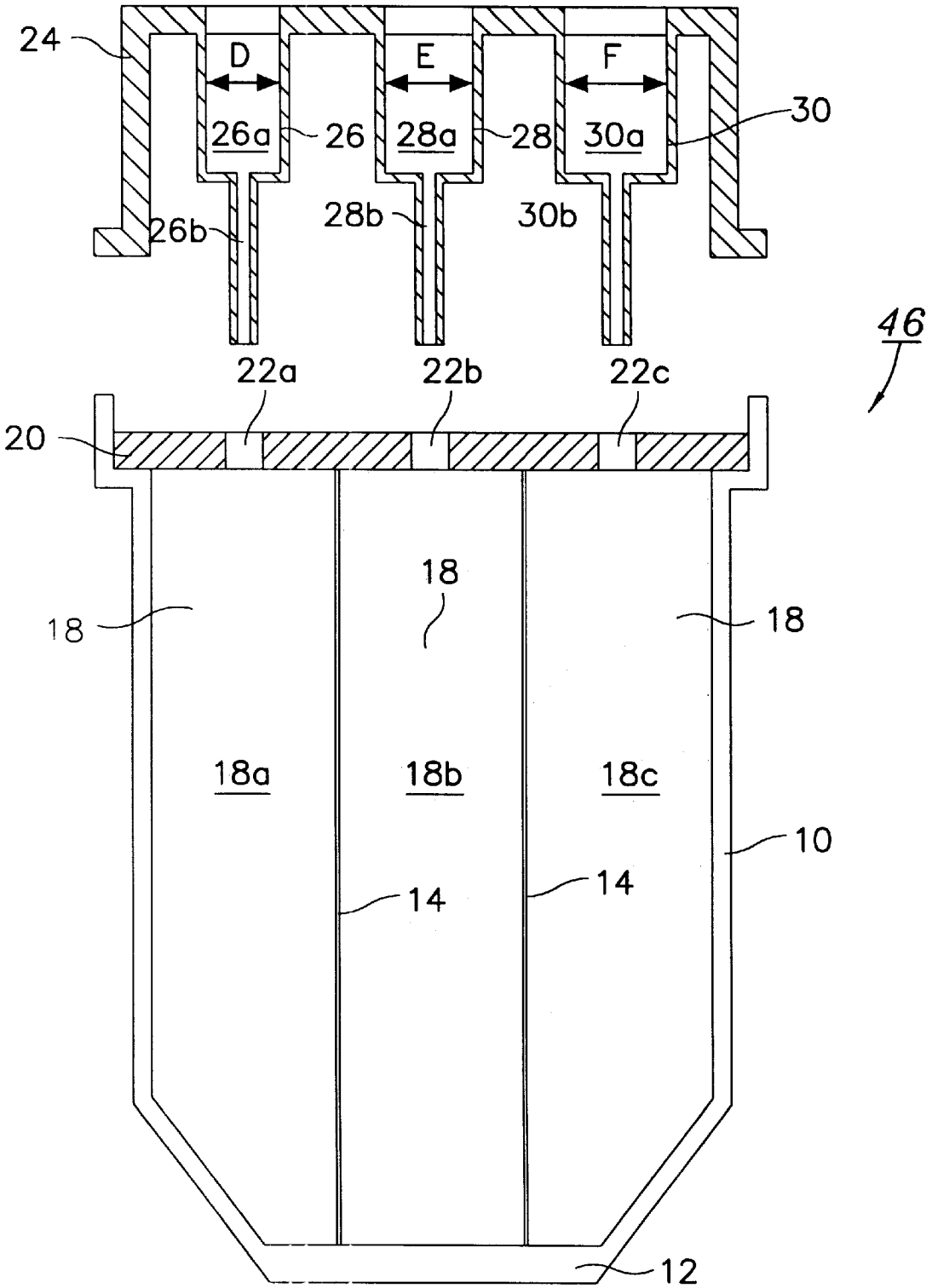
FIG. 2 is a schematic diagram for illustrating the structure of the cartridge of an inventive color ink jet printer.
Figure 3:
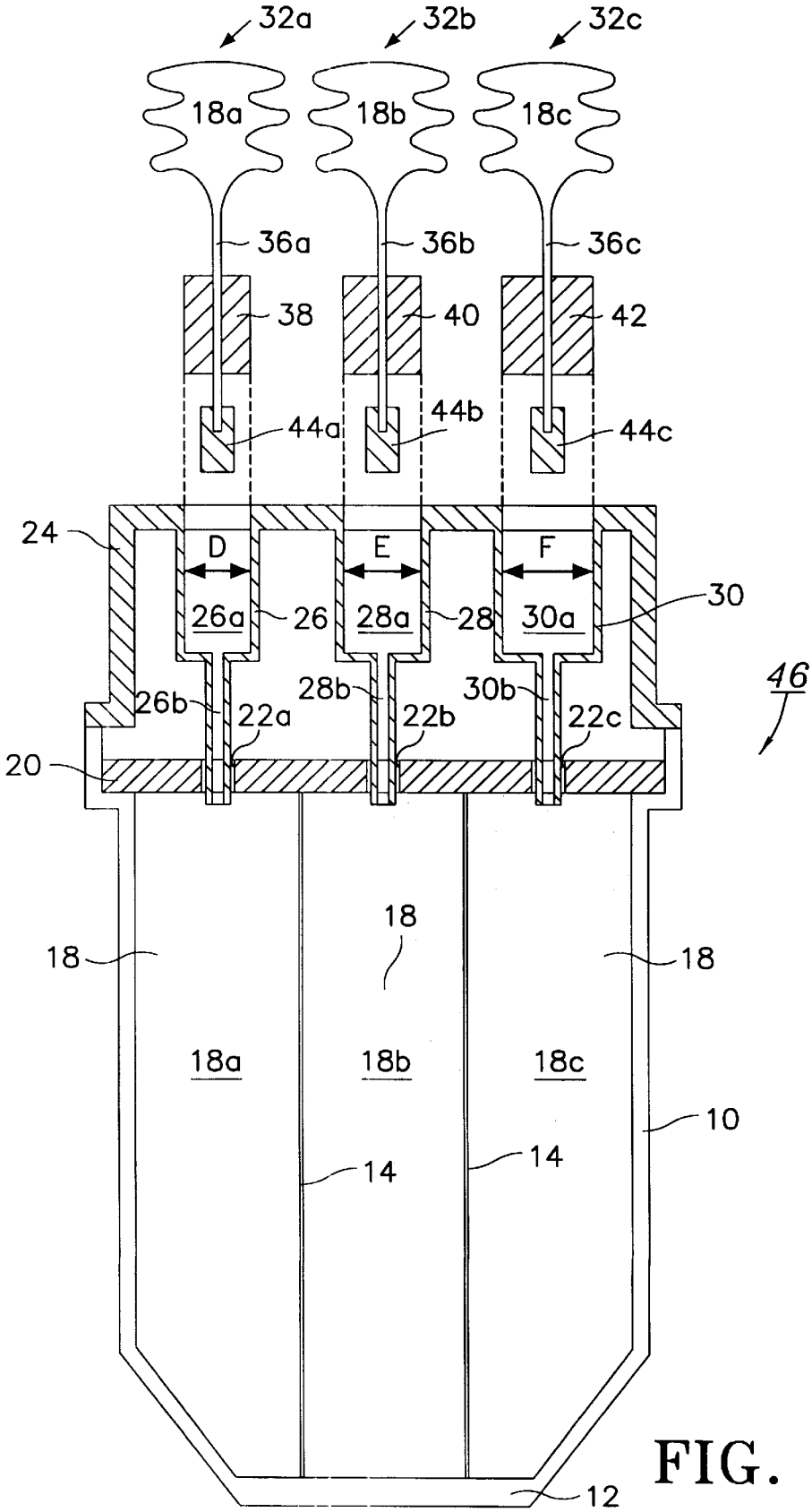
FIG. 3 is a view similar to FIG. 2 but additionally illustrating the procedure of supplying the color inks to the cartridge by means of the inventive ink supply bellows.

Referring to FIGS. 2 and 3, the cartridge 46 of a color ink-jet printer includes a print head for printing an image, an ejecting part 12 for ejecting color inks 18 according to electrical image signals from a driver, an electrical connection for supplying the ejecting part with electrical power, and an ink storage case 10 integrated with the ejecting part 12 and the electrical connection. The ink storage case 10 stores the color inks 18, and is provided with two partitions 14 to isolate the three color inks of magenta 18*a*, yellow 18*b* and cyan 18*c* from each other. Also provided between the partitions 14 and ink storage case 10 are compartments or receptacles 16 made to hold the color ink 18 with a constant pressure by capillarity. Mounted on the upper end of the inks storage case 10 is a middle cap 20, sealed so as to prevent leakage of the color ink 18. The middle cap 20 is provided with a first, second and third hole 22*a*, 22*b* and 22*c* for respectively supplying the magenta, yellow and cyan ink 18*a*, 18*b* and 18*c* to the respective receptacles The middle cap 20 is joined with the partitions 14 and ink storage case 10 by means of ultrasonic or thermal bonding.

In addition, an upper cap 24 is mounted on the middle cap 20, connected with the engine part of the ink-jet printer not shown. The upper cap 24 is provided with a first, second and third refilling part 26, 28 and 30 having different dimensions "D", "E", "F" respectively. The first, second and third refilling parts 26, 28 and 30 are formed like a hopper.

The first refilling part 26 is provided to refill the magenta ink 18*a*, and includes first and second guide passage 26*a* and 26*b* so as to prevent reverse flow of the refilled magenta ink 18*a*. The dimension of the first guide passage 26*a* is greater than that of the second guide passage 26*b*. Second guide passage 26*b* is connected to first hole 22*a*.

Likewise, the second refilling part 28 is provided to refill the yellow ink 18*b*, and includes third and fourth guide passage 28*a* and 28*b* so as to prevent reverse flow of the refilled yellow ink 18*b*. The dimension of the third guide passage 28*a* is greater than that of the fourth guide passage 28*b*. Fourth guide passage 28*b* is connected to second hole 22*b*.

Likewise, the third refilling part 30 is provided to refill the cyan ink 18*c*, and includes fifth and sixth guide passage 30*a* and 30*b* so as to prevent reverse flow of the refilled cyan ink 18*c*. The dimension of the fifth guide passage 30*a* is greater than that of the sixth guide passage 30*b*. Sixth guide passage 30*b* is connected to third hole 22*c*. The upper cap 24 is joined with the middle cap 20, partitions 14 and ink storage case 10 by means of ultrasonic or thermal bonding.

Three ink supply bellows 32*a*, 32*b* and 32*c* are provided to respectively supply the three color inks of magenta 18*a*, yellow 18*f* and cyan 18*c* through the first, second and third refilling parts 26, 28 and 30, respectively, to the receptacles appropriate receptacles. The ink supply bellows 32*a* for containing magenta ink 18*a* has a slender ink injection tube 36*a* connected to the bottom to inject magenta ink 18*a* into a receptacle, a first adapter 38 attached to the middle part of the ink injection tube 36*a* having a dimension "D" to fit the first refilling part so as to carry out the correct refilling, and a cap 44*a* covering the end of the ink injection tube 36*a* to prevent leakage of the magenta ink 18*a*. The first adapter 38 may be coated with magenta color.

The ink supply bellows 32*b* for containing yellow ink 18*b* has a slender ink injection tube 36*b* connected to the bottom to inject yellow ink 18*b* into a receptacle, a second adapter 40 attached to the middle part of the ink injection tube 36*b* having a dimension "E" to fit the second refilling part so as to carry out the correct refilling, and a cap 44*b* covering the end of the ink injection tube 36*b* to prevent leakage of the yellow ink 18*b*. The second adapter 40 may be coated with yellow color.

The ink supply bellows 32*c* for containing cyan ink 18*c* has a slender ink injection tube 36*c* connected to the bottom to inject cyan ink 18*c* into a receptacle, a third adapter 42 attached to the middle part of the ink injection tube 36*c* having a dimension "F" to fit the third refilling part so as to carry out the correct refilling, and a cap 44*c* covering the end of the ink injection tube 36*c* to prevent leakage of the cyan ink 18*c*. The third adapter 42 may be coated with cyan color.

In operation, responding to an image data from a computer, the head driver generates image signals, according to which the magenta, yellow and cyan ink 18*a*, 18*b* and 18*c* contained in there respective receptacles are evaporated by a heater ejected through the ejecting part 12 to the paper to print. As the color ink 18 contained in receptacles is consumed to such an amount as to produce missing pixel dots in the printed image due to lacking the color ink, there is a requirement for the refilling of the color ink.

In order to carry out the refilling, the ink supply bellows 32*a* containing the magenta ink 18*a* firstly detaches and gets rid of the cap 44*a* on the end of ink injection tube 36*a*, and then the first adapter 38 is inserted into the first guide passage 26*a* of the first refilling part 26. At the same time the lower part of the ink injection tube 36*a* is also inserted into the second guide passage 26*b*. In this case, as first adapter 38 fits onto and matches the first guide passage 26*a*, the user may be confident that the magenta ink 18*a* is correctly inserted so that magenta ink 18*a* will be delivered to receptacles. Consequently, compressing the ink supply bellows 32*a* will cause magenta ink 18*a* to fill the receptacles.

Likewise, the ink supply bellows 32*b* containing the yellow ink 18*b* detaches and gets rid of the cap 44*b* on the end of ink injection tube 36*b*, and then the second adapter 40 is inserted into the third guide passage 28*a* of the second refilling part 28. At the same time the lower part of the ink injection tube 36*b* is also inserted into the fourth guide passage 28*b*. In this case, as second adapter 40 fits onto and matches the third guide passage 28*a*, the user may be confident that the yellow ink 18*b* is correctly inserted so that yellow ink 18*b* will be delivered to a receptacles. Consequently, compressing the ink supply bellows 32*b* will cause yellow ink 18*b* to fill a receptacles.

Likewise, the ink supply bellows 32*c* containing the cyan ink 18*c* detaches and gets rid of the cap 44*c* on the end of ink injection tube 36*c*, and then the third adapter 42 is inserted into the fifth guide passage 30*a* of the third refilling part 30. At the same time the lower part of the ink injection tube 36*c* is also inserted into the sixth guide passage 30*b*. In this case, as third adapter 42 fits onto and matches the fifth guide passage 30*a*, the user may be confident that the cyan ink 18*c* is correctly inserted so that cyan ink 18*c* will be delivered to elastic part 16*c*. Consequently, compressing the ink supply bellows 32*c* will cause cyan ink 18*c* to fill a receptacles. Of course, the order of refilling the magenta, yellow and cyan ink 18*a*, 18*b* and 18*c* into the cartridge 46 may be changed.

Thus, the inventive device provides various advantages especially in facilitating the correct refilling of the color ink even without additional markings on the outside of the cartridge to to distinguish colors. Moreover, since the color inks are injected into the ink storage case after the ink storage case, middle cap and upper cap are completely joined together by means of ultrasonic or thermal bonding, the procedure to assemble the cartridge becomes very convenient and the number of the steps thereof is reduced, thereby improving the productivity.

What is claimed is:

1. An ink system for an ink-jet printer, comprising:

an ink cartridge having a top side and a bottom side, said ink cartridge comprising:

a body enclosing a plurality of inks, each being capable of being a different color, a plurality of partitions dividing said body into a plurality of compartments, each of said compartments accommodating one of said inks, an ejecting mechanism disposed on said bottom side for ejecting said inks, a middle cap attached to said top side of said body to prevent said inks from flowing out of said compartments, and an upper cap attached to said middle cap and having a first plurality of connectors, each of said first plurality of connectors being aligned over a respective one of said compartments and having a distinctly sized configuration; and a device for refilling said ink cartridge,said device having a second plurality of connectors, each having a size corresponding to the size of a respective one of said first plurality of connectors;

said device being engagable with said ink cartridge by inserting said second plurality of connectors into corresponding ones of said first plurality of connectors, thus correlating said inks in said device with said inks in said compartments of said ink cartridge;

wherein said device further comprises a plurality of tubes, each of said tubes passing through an interior of a respective one of said second plurality of connectors.

2. The ink system of claim 1, wherein said body further comprises three said compartments.

3. The ink system of claim 2, wherein each of said first plurality of connectors has a first section and a narrower second section protruding into one of said compartments.

4. The ink system of claim 3, wherein each of said plurality of tubes penetrates said narrower second section of a respective one of said first plurality of connectors when said second plurality of connectors is inserted into said first plurality of connectors.

5. An ink system for an ink-jet printer, comprising:

an ink cartridge having a top side and a bottom side, said ink cartridge comprising:

a body enclosing a plurality of inks, each being capable of being a different color, a plurality of partitions dividing said body into a plurality of compartments, each of said compartments accommodating one of said inks, an ejecting mechanism disposed on said bottom side for ejecting said inks, a middle cap attached to said top side of said body to prevent said inks from flowing out of said compartments, and an upper cap attached to said middle cap and having a first plurality of connectors, each of said first plurality of connectors being aligned over one of said compartments and having a distinctly sized configuration; and a device for refilling said ink cartridge, said device having a second plurality of connectors, each having a size corresponding to the size of a respective one of said first plurality of connectors;

said device being engagable with said ink cartridge by inserting said second plurality of connectors into corresponding ones of said first plurality of connectors, thus correlating said inks in said device with said inks in said compartments of said ink cartridge;

said device further comprising a plurality of tubes, each passing through an interior of a respective one of said second plurality of connectors and into an interior of a respective one of said first plurality of connectors when said second plurality of connectors is inserted into said corresponding ones of said first plurality of connectors.

6. The ink system of claim 5, wherein said body further comprises three said compartments.

7. The ink system of claim 6, wherein each of said first plurality of connectors has a first section and a narrower second section protruding into one of said compartments.

8. The ink system of claim 7, wherein each of said plurality of tubes penetrates said narrower second section of said respective one of said first plurality of connectors when said second plurality of connectors is inserted into said corresponding ones of said first plurality of connectors.

9. The ink system of claim 8, wherein said distinctly sized configuration of said first plurality of connectors correlates to an appropriate one of said inks for each of said first plurality of connectors.

10. An ink system for an ink-jet printer, comprising:

an ink cartridge having a top side and a bottom side, said ink cartridge comprising:

a body enclosing a plurality of inks, each being capable of being a different color, a plurality of partitions dividing said body into a plurality of compartments, each of said compartments accommodating one of said inks, an ejecting mechanism disposed on said bottom side for ejecting said inks, a middle cap attached to said top side of said body to prevent said inks from flowing out of said compartments, and an upper cap attached to said middle cap and having a first plurality of connectors, each of said first plurality of connectors being aligned over a respective one of said compartments and having a distinctly sized configuration, each of said first plurality of connectors having a first section and a narrower second section, said first section having an end integrally and directly connected to a first end of said narrower second section, and said narrower second section having a second end protruding into said respective one of said compartments; and a device for refilling said ink cartridge having a second plurality of connectors, each of said second plurality of connectors having a size corresponding to a size of a respective one of said first plurality of connectors;

said device being engagable with said ink cartridge by inserting said second plurality of connectors into corresponding ones of said first plurality of connectors, thus correlating said inks in said device with said inks in said compartments of said ink cartridge.

11. The ink system of claim 10, wherein said body further comprises three said compartments.

12. An ink system for an ink-jet printer, comprising:

an ink cartridge having a top side and a bottom side, said ink cartridge comprising:

a body enclosing a plurality of inks, each being capable of being a different color, a plurality of partitions dividing said body into a plurality of compartments, each of said compartments accommodating one of said inks, an ejecting mechanism disposed on said bottom side for ejecting said inks, a middle cap attached to said top side of said body to prevent said inks from flowing out of said compartments, and an upper cap attached to said middle cap and having a first plurality of connectors, each of said first plurality of connectors being aligned over a respective one of said compartments and having a distinctly sized configuration, each of said first plurality of connectors having a first section and a narrower second section, said first section having an end integrally and directly connected to a first end of said narrower second section, and said narrower second section having a second end protruding into said respective one of said compartments; and a device for refilling said ink cartridge having a second plurality of connectors, each of said second plurality of connectors having a size corresponding to a size of a respective one of said first plurality of connectors;

said device being engagable with said ink cartridge by inserting said second plurality of connectors into corresponding ones of said first plurality of connectors, thus correlating said inks in said device with said inks in said compartments of said ink cartridge;

wherein said device further comprises a plurality of tubes, each going through a respective one of said second plurality of connectors.

13. The ink system of claim 12, wherein each of said plurality of tubes penetrates said narrower second section of a respective one of said first plurality of connectors when said second plurality of connectors is seated inside said first plurality of connectors.

14. The ink system of claim 13, wherein said distinctly sized configuration of said first plurality of connectors correlates to an appropriate one of said inks for each of said first plurality of connectors.

* * * * *